US012121090B2

(12) United States Patent
Camm

(10) Patent No.: US 12,121,090 B2
(45) Date of Patent: Oct. 22, 2024

(54) SAFETY POCKET, IMPROVED SHIRT WITH SAFETY POCKET, AND METHOD OF USE

(71) Applicant: Amelia Peta Camm, Hughenden (AU)

(72) Inventor: Amelia Peta Camm, Hughenden (AU)

( * ) Notice: Subject to any disclaimer, the term of this patent is extended or adjusted under 35 U.S.C. 154(b) by 188 days.

(21) Appl. No.: 17/413,921

(22) PCT Filed: Dec. 14, 2019

(86) PCT No.: PCT/AU2019/051382

§ 371 (c)(1),
(2) Date: Jun. 14, 2021

(87) PCT Pub. No.: WO2020/118384

PCT Pub. Date: Jun. 18, 2020

(65) Prior Publication Data

US 2021/0378337 A1 Dec. 9, 2021

(30) Foreign Application Priority Data

Dec. 14, 2018 (AU) ..... 2018904772

(51) Int. Cl.
*A41D 27/20* (2006.01)
*A41D 13/00* (2006.01)
*A41D 27/10* (2006.01)

(52) U.S. Cl.
CPC ..... *A41D 27/207* (2013.01); *A41D 13/0012* (2013.01); *A41D 27/10* (2013.01);
(Continued)

(58) Field of Classification Search
CPC ..... A41D 27/207; A41D 13/0012
(Continued)

(56) References Cited

U.S. PATENT DOCUMENTS 441,046 A * 11/1890 Wright ..... A41D 27/20 2/254
497,638 A * 5/1893 Diefenbach ..... A41D 27/20 2/254

(Continued)

FOREIGN PATENT DOCUMENTS

CA 2912727 A1 5/2017
EP 1421865 A2 5/2004

(Continued)

OTHER PUBLICATIONS

International Search Report in corresponding PCT application No. PCT/AU2019/051382, Feb. 28, 2020, 6 pp.

(Continued)

*Primary Examiner* — Alissa L Hoey
(74) *Attorney, Agent, or Firm* — Tredecim LLC; Sean L. Sweeney

(57) ABSTRACT

Described herein is an improved work shirt. The work shirt includes sleeves with multipart cuffs capable of being extended to provide a wearer with variable hand coverage via three coverage distances. The work shirt also includes a safety pocket. The safety pocket includes a safety catch integral to and extending from a front wall and includes a top and a safety catch back wall configured into an L-shape where the safety catch back wall extends perpendicular to the safety catch top. The safety catch is movable between open and closed configurations. The closed configuration orients the safety catch top parallel to a pocket base, with the safety catch back wall extending into the pocket parallel to a pocket back wall. The open configuration orients the safety catch top rotated away from the pocket base enlarging the pocket opening.

6 Claims, 3 Drawing Sheets

(52) U.S. Cl.
CPC ..... *A41D 27/201* (2013.01); *A41D 27/205* (2013.01); *A41D 2600/20* (2013.01)

(58) Field of Classification Search
USPC ..... 2/254, 248
See application file for complete search history.

(56) References Cited

U.S. PATENT DOCUMENTS 1,011,433 A * 12/1911 Hoffman ..... A41D 27/20 2/254
1,369,369 A * 2/1921 Walker ..... A41D 27/201 2/251
1,486,676 A * 3/1924 Nilssen ..... A41D 13/0012 2/300
1,522,664 A 1/1925 Wood
1,525,651 A * 2/1925 Lago ..... A41D 27/201 2/253
1,563,251 A * 11/1925 Chernoff ..... A41D 27/201 292/120
1,578,712 A * 3/1926 Clark ..... A41D 27/201 24/481
1,875,847 A * 9/1932 Bruce ..... A41D 27/201 2/254
2,088,287 A * 7/1937 Buxton ..... A41D 27/207 2/250
2,291,414 A * 7/1942 Slobotkin ..... A41D 27/201 2/254
2,315,620 A * 4/1943 Isbell ..... A41D 27/20 2/247
2,385,163 A * 9/1945 Riedel ..... A41D 27/207 2/254
2,415,132 A * 2/1947 Greer ..... B43K 23/001 D3/206
2,522,051 A * 9/1950 Lewis ..... A41D 27/201 D2/624
2,746,058 A * 5/1956 Greer ..... A41D 27/207 2/249
2,784,720 A * 3/1957 Royle ..... A24F 19/0064 224/241
2,988,750 A * 6/1961 Reed ..... A41D 27/20 2/248
3,782,614 A * 1/1974 Campisi ..... A45C 11/08 224/909
3,981,028 A * 9/1976 Siegel ..... A41D 27/207 2/254
4,049,117 A * 9/1977 Grimm ..... B65D 5/6688 206/270
4,165,804 A * 8/1979 Georgopoulos ..... A24F 15/12 206/95
4,240,271 A * 12/1980 Brownlow ..... F25D 3/00 62/529
4,553,269 A * 11/1985 Nowak ..... A41D 27/207 2/254
4,667,347 A * 5/1987 Greer ..... A41D 27/20 2/254
4,756,027 A * 7/1988 Buenos ..... A41D 19/0041 2/206
5,365,614 A * 11/1994 Perkins ..... A41D 27/208 2/254
5,465,836 A * 11/1995 Focke ..... B65D 85/1045 206/268
5,634,556 A * 6/1997 Focke ..... B65D 85/1045 206/268
5,784,720 A 7/1998 Mellon et al.
5,913,408 A * 6/1999 Shanahan ..... A41D 27/10 2/69
6,760,926 B1 * 7/2004 Miller ..... A41D 27/201 2/250
7,621,001 B2 * 11/2009 Ebihara ..... A41D 27/201 2/247
10,470,508 B2 * 11/2019 O'Connor ..... A41D 27/205
10,555,572 B2 * 2/2020 Diakonov ..... A41F 9/00
11,089,828 B2 * 8/2021 Boyd ..... A41D 27/205
2002/0063069 A1 * 5/2002 Bouchard ..... A24F 15/18 206/86
2003/0177567 A1 9/2003 Yoshimura
2006/0266662 A1 * 11/2006 Sugiharto ..... B65D 85/109 206/86
2012/0047631 A1 3/2012 Connolly
2012/0144544 A1 6/2012 Telfer et al.
2016/0150847 A1 6/2016 Johnson
2016/0183614 A1 6/2016 Kuipers et al.
2016/0270465 A1 9/2016 Lamprey
2017/0107047 A1 * 4/2017 Ruthemeier ..... B65B 19/025
2017/0280797 A1 * 10/2017 Bayliss ..... A41D 27/205
2018/0084852 A1 * 3/2018 Page ..... A41D 19/002
2019/0159537 A1 * 5/2019 Blythe ..... A41D 27/205
2020/0138137 A1 * 5/2020 Eckensweiler ..... A41D 27/10
2020/0352267 A1 * 11/2020 Lazic ..... A41D 27/201
2021/0213323 A1 * 7/2021 Trebino ..... A41D 27/10
2022/0053858 A1 * 2/2022 Berkery ..... A41D 27/207

FOREIGN PATENT DOCUMENTS

JP 10219507 A 8/1998
JP 2009133049 A 6/2009
WO 2015001784 A1 1/2015

OTHER PUBLICATIONS

Written Opinion in corresponding PCT application No. PCT/AU2019/051382, Feb. 28, 2020, 4 pp.
International Preliminary Report on Patentability in corresponding PCT application No. PCT/AU2019/051382, May 10, 2021, 59 pp.

* cited by examiner

SAFETY POCKET, IMPROVED SHIRT WITH SAFETY POCKET, AND METHOD OF USE

FIELD OF THE INVENTION

The present invention relates to a safety pocket, and in particular to a safety pocket that substantially prevents items from being lost from the pocket when the wearer leans forward.

BACKGROUND OF THE INVENTION

Millions of work shirts are worn by people everyday around the world. Some of these are business shirts, part of an unofficial or official uniform for an office or the corporate world. When working out of doors a work shirt is a practical item to protect the wearer from the environment while working. These are other applications share a common inclusion, one or more pockets. When working important items are often carried in the top pocket, such as a mobile phone, cash or credit cards. A standard work shirt pocket has a small flap and a button closure and is relatively small. A small phone may fit but the larger phones will not comfortably fit, nor will a notebook.

One of the issues with standard pockets is that it is very convenient to have items that you may wish to access quickly such as a phone, cash or cards, notebook and pencil in easy hand reach. But to do so you need to open the buttoned flap each time. Where the phone is too big for the pocket it will protrude slightly and the person will be unable to button the flap to close the pocket.

Most frequently were a person needs to carry items in the pockets of their work shirt and access them through the day they will get lazy and fail to button up the flap. When walking around or sitting the fact that the button is not done up and the flap over the top of the pocket is not so much of a problem. However, if the person were to lean forward, forgetting about any items in the unsecured pocket may fall from the pocket and out on the ground. Where there is a mobile phone in the pocket this may slide out very easily under gravity and smash on the ground; a costly mistake. For men using a toilet, a common problem is the contents of the top pocket accidently falling out into the toilet bowl, again which is likely to ruin a mobile phone. Heavy items are particular prone to this costly accident.

When working out on a property, farm or other outdoor occupation, the person may be travelling and so ready access to other ways to carry a phone may not be available. For example, when riding a quad or motor bike, or riding on a horse a person may be working the land but will not be easily able to stop and access a phone, unless it is in their shirt pocket. Out on the land in a vehicle or when walking it is often important to have these communication devices for safety and to keep in touch with other workers. A two-way radio or other devices may be similarly carried. Modern practices require frequent data entry and recording throughout the day and other use of smart phone apps. Therefore, it is imperative that a person can carry their phone with them and that there is very quick and easy access to the phone, and that it is kept safe in the potentially dirty or hazardous environment.

Any other useful small items may be carried in a top pocket, a knife, twine, fixings, anything that is small and needed to be kept safe. When working outdoors or perhaps in a trade, the same problems apply that frequent access to the pocket may mean that at times the flap at the top is not properly secured, and so the items contained therein vulnerable to falling out. The time required to unbutton and button the flap adds up over a day when a person may need to access the pocket a dozen or more times. In the end the flap and securing button are often left undone, while working. If the person has items in the top pocket and then leans forward, or is any position other than upright when working the items in the pocket may slip out. When working outside there are further risks, the items may fall to the ground and break or smash, or if travelling the items may fall out and be lost. Items thrown into bush land can be impossible to find again. When working with animals and the like, the items such as a phone if dropped amongst cattle for example will quickly be crushed. Also working may involve dealing with dirty or unsanitary situations such as disposal of dead animals or faeces. In these circumstances it would be highly undesirable to loose important items such as a mobile phone or important tools, from the safety of the pocket into contact with the dirt, flesh or faecces.

Therefore, the inventor has developed a new type of pocket, applicable to any pocket, or any shirt, including an improved shirt that not only improves the security but is also much quicker and easier to close than a button closure. The invention cleverly combines a safety mechanism if the person forgets to latch or button up the pocket, to stop the items falling out as they lean forward, enabling continuous easy access to the items. Even the larger mobile phones or notebooks can be kept in the larger secure pocket, and kept safe through use of the safety pocket.

The invention enables a person to tip over in any direction or even be inverted and the contents of the pocket remains safe and secure in the pocket. The inventor has further developed and improved shirt with other features useful when working, as well as a form of the pocket that can be retrofitted to existing shirts. The shirt is adapted to have larger stronger pockets that can carry more items, and securely. Other features such as the longer arms, assist movement when working and act against disturbance to the pockets and their contents, as the wearer moves. The longer cuffs can be folded back or allowed to fall down to protect the hands of the wearer to give greater options in sun, rain or wind conditions, all problems when working outside. The secure pocket is a very clever way to solve a problem that has been around for a long time, with no suitable solution found. The quick catch mechanism can be operated with a single hand, and a quick flick to move between access of the pocket or securing, ready to go back to work. The inventor is very hopeful that in addition to her other inventions her products will enable safe and secure keeping of personal items such a mobile phone.

The following describes non-limiting examples of the invention being used with reference to the pocket of a shirt, as a useful example. The safety pocket can be used on any shirt, or any garment including dresses, skirts or trousers, or in fact anywhere the safety pocket may be useful. In one form of the invention the safety pocket is part of an improved shirt, as a multifaceted form of the invention. However, it should be understood that the safety pocket, may be used anywhere that it may be useful to include the safety pocket, not limited to shirts, garments or anywhere other than as specifically defined in the claims. Moreover, any or each of the clever aspects of the improved shirt may be used individually or in combination.

For clarity, any prior art referred to herein, does not constitute an admission that the prior art forms part of the common general knowledge, in Australia or elsewhere.

It is an object of the present invention to provide a safety pocket that at least ameliorates one or more of the aforementioned problems of the prior art. It is a further and separate object of the present invention to provide an improved shirt with safety pocket that at least ameliorates one or more of the aforementioned problems of the prior art. It is a further and separate object of the present invention to provide a method of use of a safety pocket that at least ameliorates one or more of the aforementioned problems of the prior art. It is a further and separate object of the present invention to provide a method of use of an improved shirt with safety pocket that at least ameliorates one or more of the aforementioned problems of the prior art.

DISCLOSURE OF THE INVENTION

Accordingly, the present invention provides a safety pocket for a work shirt, the safety pocket including:

- a pocket body suitable to receive items that the wearer would like to carry with them with ready access;
- a back wall of the pocket body, associated with the work shirt;
- a front wall of the pocket body;
- a base of the pocket body formed between the front and back of the pocket body;
- an opening to the pocket body formed between the front and back of the pocket body,
- a safety means, associated with the opening, wherein the safety means acts to substantially catch and hold the items within the pocket body if the person leans forward while wearing the shirt, and the safety means can be moved between an open state, where items can be put inside the pocket body, and a secure state where items are substantially prevented from passing through the opening when the person leans forward, with a single, easy action.

Accordingly, the invention also provides a safety pocket for retrofitting to a work shirt, the work shirt including a pocket body, the safety pocket including:

- the pocket body of the work shirt being suitable to receive items that the wearer would like to carry with them with ready access;
- a back wall of the pocket body, associated with the work shirt;
- a front wall of the pocket body;
- a base of the pocket body formed between the front and back of the pocket body;
- an opening to the pocket body formed between the front and back of the pocket body, a safety means, associated with the opening of the pocket body, and attached thereto by one or more fastener means to the pocket and a safety catch of the safety means to enable opening and closing in a secure manner and the safety means includes walls on three sides pointing inwards, somewhat similar to a packet of cigarettes, so that as the items fall against the safety means the safety means substantially prevents the items falling out, wherein the safety means acts to substantially catch and hold the items within the pocket body if the person leans forward while wearing the shirt, and the safety means can be moved between an open state, where items can be put inside the pocket body, and a secure state where items are substantially prevented from passing through the opening when the person leans forward, with a single, easy action through use of the security means catch.

The safety pocket may take any suitable form. The work shirt may be any kind of shirt, used for working. The working may be office work, outdoor work, indoor work, gardening, trade work, work on the land, for example. In other forms of the invention the pocket may be used in any shirt, blouse or similar garment. The pocket could be used in other garments or applications. The work shirt maybe a tough work shirt designed to be worn when working outside. The work shirt may be made of a strong material, such as cotton.

The worker may be any suitable worker wearing the pocket or shirt. The worker may be chosen from the following list: agriculturalist; cattle farmer; farm worker; fencer; gardener; horse-rider; office worker; roofer; and trade professional.

The pocket body may be any suitable shape. The pocket may extend and expand to its full capacity when containing items but may lie flat when not in use or only containing small items. The pocket body may be generally a cuboid shape, similar to a conventional pocket. The pocket body may be a similar shape to a conventional pocket but larger to contain larger items. Preferably, the pocket body is larger than a standard pocket to safely container larger items. Preferably, the pocket body is wider than a standard pocket to enable more items to be contained. Most preferably, the pocket body is adapted to contain a mobile phone. Preferably, the pocket body is adapted to fully contain a mobile phone. Preferably, in the larger style phones or phablets may be contained in the large pocket body. Preferably, the pocket body is adapted to carry the items a worker may wish to carry in a top pocket such as a phone, card, notebook, or keys, with ready access but secured due to the use of the safety means.

There may be multiple safety pockets. Where multiple safety pockets are used these may be of different sizes. For example, it may be desirable to carry a large phone separate from other items such as keys or coins which could scratch the phone. A large safety pocket will then be used on the shirt for the phone and a second, perhaps smaller safety pocket will be used for the other items to be kept safe.

Most preferably the pocket body is configured to be suitable to contain items to be carried and withstand damage and wear. Most preferably, the items are fully contained within the pocket body.

The items may be any suitable items. Preferably, the items include valuable items or items it is desired not to lose. The items may be a single item. The items may be any suitable number of items. For example, where small fastenings may be carried for work there could be 20 such items. In other situations, one pocket body may fully contain a phone and the other some change, cards and keys. The options for items to be carried will very much depend on the nature of the work the person is carrying out, or the circumstance of use. The items may be chosen from the group: credit or other cards; cash; coins; keys; mobile phone; security pass items; small items for working on a task, such as fixings; or small tools.

Use of the safety pocket in a top pocket location is useful to allow ready access, however, other locations may be used. The ready access to the items may be through one hand to a top pocket location. The ready access may be any suitable access that can easily be reached and achieved with one hand when working on other tasks.

The pocket body may be formed between a front and back of the pocket. A base may be included between the front and back of the pocket. One or more sides of the pocket body may be included. Preferably, a pair of opposed sides may be included between the front and back of the pocket body. The pocket body is preferably made up a back wall, front wall, base and sides, similar to a standard pocket but generally larger and including the inventive features. The back wall could be omitted and the three sides form the pocket body with the front of a shirt with an inferior form of the invention. The back wall is preferably substantially rectangular in shape, sized to be suitable to receive items in pocket body to be carried. The back wall may take any suitable shape or size, suitable for the particular application. The front wall is preferably substantially rectangular in shape, sized to be suitable to receive items in pocket body to be carried. The front wall may take any suitable shape or size, suitable for the particular application. The side walls may take any suitable size or shape. Preferably, the side walls form a general cuboid shape with the front and back walls. Preferably, the side walls are wider than a standard pocket so as to container larger items. Preferably, the pocket body includes wide side walls to extend internal size of the pocket body so larger items can be received therein when compared to a standard pocket. Preferably, the side walls are the same as one another and form a pair of opposed sides. These sides could be different from one another in other forms of the invention. Preferably, inclusion of wide extending side walls in the pocket body is very useful to extend to capacity of the safety pocket.

Preferably, the base is of a suitable size to enable the pocket to contain items and be fully contained. Preferably, the base gives additional size to the pocket when compared to a standard pocket. Preferably, the base is a wide base. Preferably, a wide base and wide sides are included to give a larger pocket capacity to safely contain items.

The opening may take any suitable form. The opening may include elastic or other partial closure means as an additional means to maintain items in the pocket body when the wearer leans forward. Preferably, the safely means closes most of the opening. Preferably, only fingertip access is provided through the opening so that a person may put their finger-tips in and lift the safety means up, to put items inside. The opening is preferably, mostly closed in the open state by the safety means. Preferably, the opening is substantially closed by the safety means. Preferably, items are substantially prevented from leaving through the opening by the safety means. Other features and closures may be included for additional closure of the opening. The additional features may a material flap and button, or press-button fastening for example.

The safety means has been carefully designed to not impede regular or repeated access to the items in the pocket but also preventing the loss of the items through the opening when leaning forward. Preferably, the safety means includes walls on three sides pointing inwards, somewhat similar to a packet of cigarettes, so that as the items fall against the safety means the safety means substantially prevents the items falling out. Preferably, in one form of the invention, the safety means includes a lip member to catch items. The safety means may include a wall member to act against loss of items from the pocket. The safety means may include one or more wall or lip member to act against loss of items forward on tipping. Preferably, the use of the safety means is similar to the use of a standard pocket, so there is no further impediment to use. Preferably, no fasteners need to be undone to access the items. Preferably, the retaining of the items by the safety means is automatic, no further action is required to maintain the items safely in the pocket through use. Due to the nature of items if the person tips forward and is right upside down the items will continue to be held by the safety catch and not fall out. The invention is a very useful one to stop the accidental loss of items such as keys, cash, cards or a phone from the pocket. The invention may stop the exit of items from within the pocket through the opening in any suitable manner through us of a physical barrier that resists the passing of items through the opening. Preferably, the barrier encourages the items to return to the body of the pocket on returning to upright orientation.

Preferably, the safety means is very strongly attached to the pocket body. In some forms the safety means is formed with the rest of the pocket, or attached thereto, or may be retrofitted to a standard pocket. The safety catch is substantially prevented from parting from the pocket body. The safety catch may be formed as part of the pocket body. The safety catch may be attached to the pocket body. The safety catch may be made of metal. Any suitable material for the safety catch may be used. Preferably, the safety catch includes a means to attach strongly to the pocket body. This may be integrally by being sewn into the pocket. The safety catch may include clips and the clips may be used to strongly attach to the pocket. In this form of the invention the safety means is detachable. The clips may be metal clips to slide down the sides of the pocket body, somewhat similar to the retrofit version described elsewhere. Most importantly the safety means is attached to the pocket body so as not to become detached therefrom in use.

Preferably, the safety catch includes part that forms a closure across at least part of the opening. The safety catch part may form substantially a "roof" to the pocket body opening. Preferably, the part is a substantially flat part, to form a roof or closure to the opening. Preferably, the safety means includes a wall extending from the roof part. Preferably, the wall and roof part for an L-shape. The L-shaped part may be similar to a carton or packet of cigarettes in formation, as an example. Preferably, the items will fall into and be held by the L-shape of the safety means so that as the person tips forward the items do not fall through the opening. Preferably, the location of the safety means, close to the front wall means that as the person tips forward, the items are tipped into the L-shaped part, forming a catch to hold the items. When inverted the L-shape will assist to hold the items in the pocket and pressed against the front of the pocket body.

Accordingly, the present invention provides in a variant, a safety pocket that may be retrofitted in a work shirt, the safety pocket including:

- a pocket body suitable to receive items that the wearer would like to carry with them with ready access;
- a back wall of the pocket body, associated with the work shirt;
- a front wall of the pocket body;
- an opening to the pocket body formed between the front and back of the pocket body,
- one or more fasteners to clip the pocket body to a standard pocket; and
- a safety means, associated with the opening, wherein the safety pocket is installed in a standard pocket through use of the fasteners, and safety means acts to substantially catch and hold the items within the pocket body if the person leans forward and the safety means may be moved between an open state, where items can be put inside the pocket body, and a secure state where items are substantially prevented from passing through the opening when the person leans forward, with a single, easy action.

Preferably, the retro fit form works as for the safety pocket described elsewhere. Preferably, the safety pocket will include body, attachable to the pocket through use of one or more fasteners. Preferably, a pair of fasteners are used to attach the body to the pocket. Preferably, the fasteners are strong and secure fasteners. Preferably, the fasteners are able to slideably attach the body to the existing pocket to maintain the retrofitted safety pocket securely in place. The fasteners may take any suitable form. Preferably, there are a pair of fasteners Preferably, the fasteners are clips. Preferably, the clips are metal clips. Preferably, the clips include sliding parts which allow them to readily slide on, in one direction and resist removal in the other direction. Preferably, the clips are made of a strong light metal material. The fasteners may be long fasteners of at least 100 millimetres long. Preferably, the clips very strongly attach the safety pocket to the standard pocket, resisting removal until removed by the wearer. Preferably, the clips include decoration. The retrofit pocket may be adaptable to fit in a range of pocket sizes.

Preferably, the safety pocket is a pocket of at least 100 millimetres square. The safety pocket may be 115 by 105 millimetres. Any suitable size pocket may be used. A range of retrofit pockets may be available to suit different pocket sizes or styles. Elastic may be included in the safety pocket in any of its forms. Elastic may be included to assist to extend the size of the pocket. Elastic may be included to assist to hold oversized items in the retrofitted pocket. Preferably, the safety pocket in the retrofit form has any one or more features of the invention. Preferably, the safety pocket can be retrofitted to any garment pocket through use of an appropriate fasteners. In this form of the invention the sides of the pocket may be reinforced to assist in holding the safety means and pocket strongly together and maintain the items in place.

The safety pocket may be used with any suitable pocket, of a shirt, blouse, jacket, dress, skirt or trousers, for example.

Preferably, the safety pocket in any of its forms or variants is included in an improved shirt.

Accordingly, the present invention provides in a variant, an improved shirt with safety pocket for a work shirt worn by a worker, the safety pocket including:

- a pocket body suitable to receive items that the wearer would like to carry with them with ready access;
- a back wall of the pocket body, associated with the work shirt;
- a front wall of the pocket body;
- an opening to the pocket body formed between the front and back walls of the pocket body,
- a safety means, associated with the opening, wherein the wearer can wear the shirt, like a convention shirt, and the safety means acts to substantially catch and hold the items within the pocket body if the person leans forward and the safety means may be moved between an open state, where items can be put inside the pocket body, and a secure state where items are substantially prevented from passing through the opening when the person leans forward, with a single, easy action.

Preferably, in any of the forms of invention a base to the pocket is included between the front and back sized suitable to hold the desired items. Preferably, one or more side to the pocket is included. Preferably, a pair of opposed sides are included between the front and the back of the pocket body, sized to enable larger items to be maintained in the pocket body. Preferably, the pocket body is configured to be a larger than standard pocket body to safely contain larger items. The back of the pocket may be formed from the shirt itself. Or the back of the pocket body may be formed from an additional piece of material.

Preferably, the improved shirt includes long sleeves, longer than a standard shirt to allow greater freedom of movement when working. Preferably the shirt is made from a strong hard-working material. Preferably, the long sleeves include adaptable cuffs. The adaptability may be to fold out to be long sleeves, to cover the hands for example. The long cuffs are very useful to protect the hands when riding a bike or horse, or working out in the sun, such as tailing cattle or sheep. The longer arms also provide greater scope of movement and so comfort for the user while performing tasks. The cuffs may extend 150 or 200 millimetres to cover the hands while working. Preferably, the adaptable cuffs includes a plurality of states, including long, normal and short to suit the length of sleeve to cover the hands, normal length and a short length above the wrist to facilitate working. Preferably, the adaptable cuffs include a long state where the cuffs substantially cover the hands of the wearer to protect them from the sun or other environmental factors. Preferably, the adaptable cuffs include a plurality of states, including the long state to substantially cover the hands of the wearer. Preferably, the adaptable cuffs include a long state, short state and normal or standard state to enable the user to adapt the length of sleeve to their work readily. Unlike standard sleeves that may be rolled up, thicker work shirts are more difficult, and so tend to be worn in the long sleeve form. The clever adjustable cuffs enables a worker to quickly secure the cuffs in the different states to enable working. For example, in a mucky job a person may wish to quickly secure the cuffs in the shorter state, above the wrists, to be out of the way of the muck. The shirt sleeve still needs to protect the majority of the arm from the sun and the elements and so the minimised short sleeve is useful. The normal state is neither long nor short and useful for most jobs. Where the sun in strong and in the main part of the day a person may which to protect their hands when their hands are being used out in the sun. The long state is then very useful. A press fastener may be used to readily exchange states and hold the adaptable cuff in the short, normal or long state. Any number of suitable states may be used instead.

Preferably, the safety pocket of the improved shirt has any one or more features of the invention described above. Preferably, the safety pocket of the improved shirt is the safety pocket of the invention. There may be several safety pockets included in the improved shirt. More than one safety pocket may be included on any suitable garment or shirt including retrofitting.

Accordingly, the invention provides a method of use of a safety pocket, the safety pocket including a pocket body, with front and back, defining an opening and a safety means associated with the opening, the method including the following steps:

a) accessing the opening of the safety pocket through the opening with the fingers;
b) lifting or flicking the safety means to open the pocket body;
c) placing one or more items into the pocket body;
d) removing the fingers and flicking the safety means back to substantially close the opening, whereby if the wearer leans forward the safety means substantial prevents loss of the items through the opening.

It will be apparent to a person skilled in the art that changes may be made to the embodiments disclosed herein without departing from the spirit and scope of the invention in its various aspects.

INDUSTRIAL APPLICABILITY

The safety pocket and safety pocket shirt, can both be manufactured industrially for supply to wholesalers, retailers or direct to the customer.

BRIEF DESCRIPTION OF THE DRAWINGS

The invention will now be described in connection with a non-limiting preferred embodiment with reference to the accompanying drawings, in which.

DETAILED DESCRIPTION OF THE INVENTION INCLUDING A BEST MODE

Figure 1:
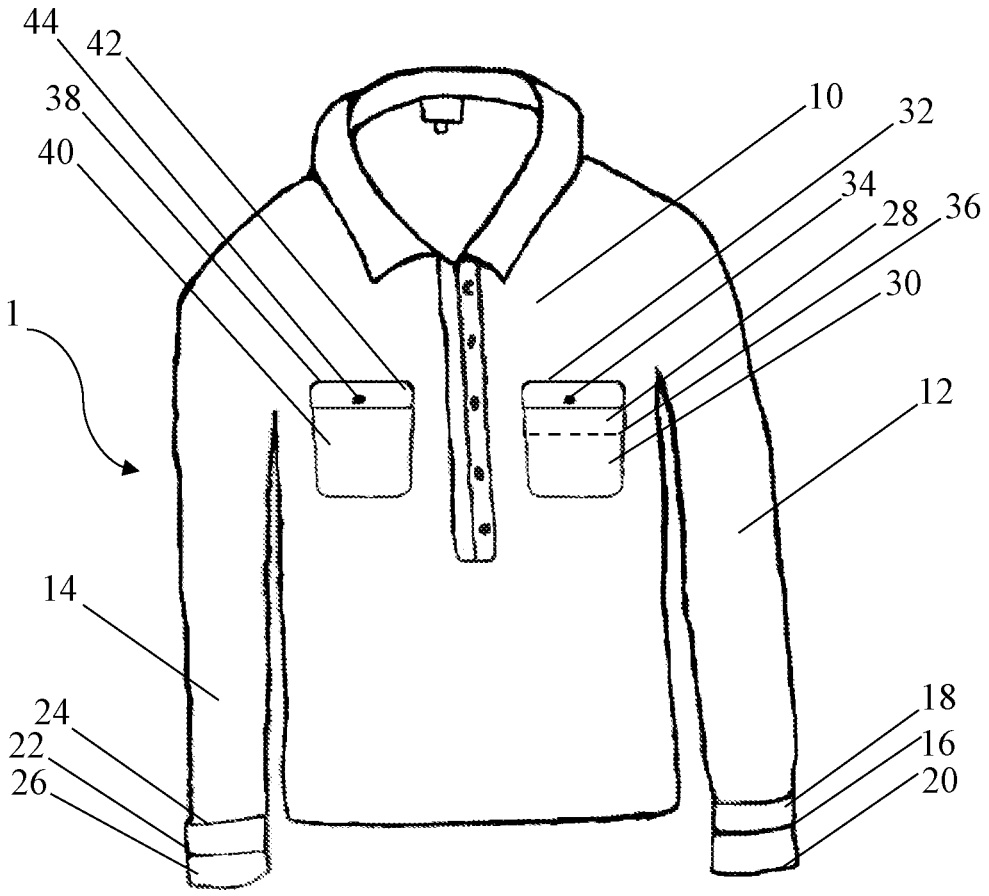
FIG. 1 is a front view from of an improved shirt with safety pocket, according to a first preferred embodiment of the invention.
Figure 2:
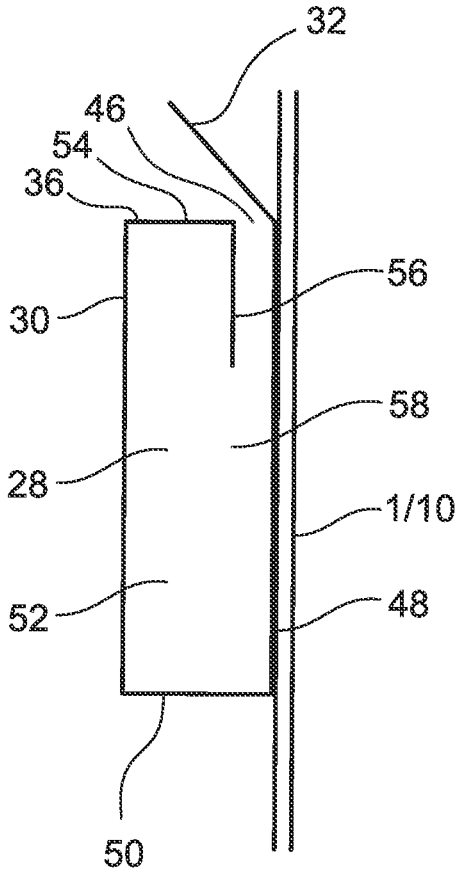
FIG. 2 is a side detailed view of the safety pocket of the improved shirt of FIG. 1, illustrating the large size to contain items and the safety catch.

Referring to FIGS. 1 to 2, a first preferred embodiment of the invention will be described, where improved shirt 1 is illustrated including two improved pockets and many other individual features that make a very useful and surprisingly beneficial product.

For those that work on the land, or in trades, a quality shirt becomes the uniform worn, and we expect that the subject improved shirt will prove popular to replace the regular work shirt worn, due to the numerous added features. Improved shirt 1 includes front of shirt 10, with first sleeve 12 and second sleeve 14. The form of the shirt is somewhat recognisable as similar to a standard work shirt but has differences as described further below. The shirt may be an office shirt, dress shirt or work shirt and the material used will reflect the purpose to which the shirt is to be put. As illustrated the shirt is made of a strong brushed cotton material suitable for working outdoors. The material protects the wearer as has a suitable thickness, such as from scratches, as well as from the weather, the sun, wind and to some extent the rain. Any suitable alternative may be used but as would be understood the weight of the material should be suitable to resist wear and to comfortably hold the items in the safety pocket.

Sleeves 12 and 14, of shirt 1 are longer than a standard shirt 70 millimetres longer, to add extra movement and comfort, particular when working. These long sleeves are very useful as one of the issues with a standard shirt, and carrying things in the pockets, is the restricted movement. When working manually the person will move their arms in the full range of motion, including reaching up and down, to the sides. The longer arms of the shirt enable easy movement, and, importantly as the body of the shirt is not stretched or strained the pockets are undisturbed by the movement. The length of the sleeves therefore assists for the body of shirt 1 and front 10 from being stretched during movement. The person is more comfortable having this additional range of motion but also can move freely without a concern that the movement may pull the pockets and cause them to shift or spill (noting that this will not occur provided the safety catch is in place, see below).

In addition to long sleeves 2 and 14, cuff 16 is included on sleeve 12, with upper part 18 and lower part 20 and corresponding cuff 22 is included on sleeve 14, with upper part 24 and lower part 26. Both cuffs 16 and 22 further extend the length of sleeves, approximately 100 millimetres to give hand coverage, and give options for three lengths suitable for different tasks and environmental conditions. Again, the long sleeves assist free movement when working but cuffs 16, 22 have a further function. When working outdoors the weather can be harsh, there may be extreme heat and the need to protect from the sun, or biting winds, or rain. To be able to extend long cuffs 16 and 22 to fully cover the hands is very useful, to provide additional protection. The protection can be from heat or cold and enables a highly adaptable cuff. The two part construction of upper parts 18, 24 and lower parts 20, 26 means that these can readily be worn long, or folded up to short, or kept in a middle range, three length options. In some circumstances it is desirable to keep the cuffs of the shirt elevated from the hand to keep safe from machines for example, or clean away from dirt and much.

Having inbuilt options for the cuffs makes a much more secure means to hold the cuff in any of the three positions. Fasteners are included to hold the cuff in the desired mode for work and these can easily be moved up or down for other modes. The adaptability of the work shirt cuffs, on the already longer sleeves makes for a very useful work shirt particular for manual work, or work in many different circumstances where it is desirable to adapt shirt for use in different situations. Safety must always be the main criteria, but enabling the person to be safe, with their sleeves held out of the way, and then have them long for comfort in other parts of the day is very useful. If anyone has tried to work with rolled up sleeves for anytime will realise that these do not stay rolled up for long. The subject improved shirt is most advantageous in that it allows adaptability of sleeves with the sleeves held securely in which every option is preferred, short, normal or long for the task at hand.

First safety pocket 28 is inventive in its own right, part of an improved shirt or may be retrofitted as described in the second embodiment below. As described as part of improved shirt 1, first safety pocket 28 is included being an inventive secure pocket to keep items when working. Safety pocket 28 can be seen in FIG. 1 to be a larger pocket than standard pockets having front wall 30 with flap 32 and button 34. The flap and button is the standard means of keeping items in a pocket but here are used as an addition, which may be buttoned down, for an extra level of security. However, the pocket itself will maintain the items in the pocket, even if the person hangs upside down, through use of the safety catch 36 of the new safety pocket. Option use of the flap and button would be understood to be in the usual manner.

Second safety pocket 38 can also be seen on FIG. 1, and as illustrated is a smaller pocket, but could also be the same or bigger than the first pocket. Second safety pocket 38 is similar to the first with front wall 40, and flap 42 with button 44. The means to keep items in the second pocket 38 is the same as described below for first safety pocket 28 but this is not specifically shown or described.

With reference to FIG. 2, a side view of first safety pocket 28 is shown which shows the clever features that enables the invention to maintain items in the pocket when the wearer leans forward, or even stands on their head. Opening 46 is at the top of safety pocket 28 and it is through opening 46 that items can be placed in pocket 28. Pocket 28 is sized to be bigger than a standard pocket, which assist optimal working of the safety pocket and so that larger items such as the larger mobile phones, can be put inside. Other items such as cash, cards, security devices or radios can also be put in this larger pocket. The pocket may be adapted for different uses, to be smaller or larger. However, it is advantageous to have the larger pocket particularly for convenient enclosure of mobile phone. Really any items could be put in the pocket, and kept secure such as fixings when mending things, veterinary supplies, any small items that is important are kept secure. The items will vary with the application and the wearer.

Back wall 48 as shown is the back wall of pocket 28 attached to front of shirt 10. These two surfaces may be made together, in a strong integrated fashion or be attached to one another during manufacture. To form pocket 28 front wall 30 is opposed back wall 48, surrounding base 50, with side walls 52 on either side. In this way front 30, back 48, sides 52 around base 50 with opening 46 form a cuboid shape for receipt of items. Being made of material, the same is approximate as it may be stretched somewhat by the items but also when empty will lie flatter against front of shirt 10. The shape of pocket 28 is therefore similar to a standard pocket but is longer and wider to take larger items.

Notably, safety pocket 28 also includes safety catch 36 which is crucial to the maintenance of items safely in the pocket. Safety catch 36 is formed with front wall 40 integrally so to be very strongly attached. Safety catch 36 continues from the integral front wall 40, to run substantially parallel with base 50, as top 54. Top 54 lies across most of opening 46 but does not close it off, as there is room to put the wearers fingers in the gap, as it is through here that the quick flick open action occurs. At the end of top 54 is back wall 56 of safety catch that runs parallel with front of shirt 10 and back wall 48 of pocket 28. Space 58 is useful inside the pocket for containing items including a mobile phone as described elsewhere.

Safety catch 36 almost blocks opening 46 and as a person leans forward, perhaps forgetting that they have items such as a phone in their top pocket safety catch 36 prevents the items falling out. The nature action is as the person bends or falls forward items fall to the front of the pocket and then if inversion occurs sufficient where usually the item would fall out of opening 48 this is prevented by top 54 of safety catch 36. The adaptable design enables different pocket configurations to be used for different shirt types, or for different items to be held. For example, for a work shirt, a mobile phone and notepad would need to be carried and so a larger secure pocket would be desirable, with a longer body into which the items can slide. The safety catch part will be lip or wall that may extend a third of the way into the pocket to strongly and securely catch the items as the person leans forward. In a dress shirt, a smaller, pocket may be all that is necessary to hold cash, cards or keys, or other small items, or just a phone and cards. It is still very useful that these items are held safe, and the pocket may still be larger than a standard pocket, or in some forms the same size. Even smaller pockets could be used with the invention in some forms.

Use of stiff, or double thickness material on the lip or roof of the safety pocket in any of the forms may assist to hold the opening open when items are inside the pocket.

The particular form of the invention can be varied within the scope for numerous useful applications. The clever design will work even if the person hangs upside down as the items catch into the safety catch and are very firmly held.

Safety catch 36 is form similar to the lid of a cigarette packet, having an L-shaped profile that points inwards, so as the person tips forward it forms a lid to catch and push back the items that would otherwise fall out. The lid an reflecting back wall act together as a physical barrier but more than that to bias the items back into the pocket. As the person returns to the upright position the lid also helps the items to gently be return to the pocket. The whole process is smooth and seamless, the person has prevented loss of items from the pocket and these return to the pocket but the usual method of use is unaltered and there is no inconvenience experienced in any stage of use.

A person may be working outside for a day, and will need to be in communication through the day on the phone. The person puts the phone into space 58 of pocket 28. To do so the fingers are put into the gap between back wall 56 of safety catch 36 and back wall 48, and easily flip up the lid in a quick hand action and in drops the mobile. As the fingers release the material of pocket 28 assists to bring it back to shape and safety catch 36 into place. As the person works they need to lean forward but this will be no problem as safety catch 36 will automatically move with the action and "catch" the phone or items within pocket 28 to prevent them falling out. Back wall 56 is particularly helpful to catch items and prevent them slipping out of the very narrow aperture.

Figure 3:
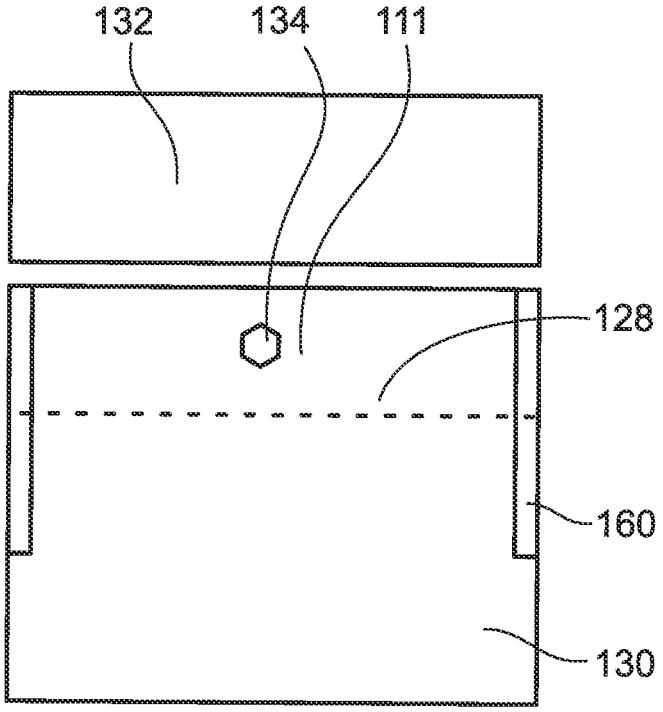
FIG. 3 is a front view of a safety pocket of a second preferred embodiment of the invention, where a safety pocket is usefully retrofitted to a standard work shirt pocket (standard work shirt shown only in FIG. 5)
Figure 4:
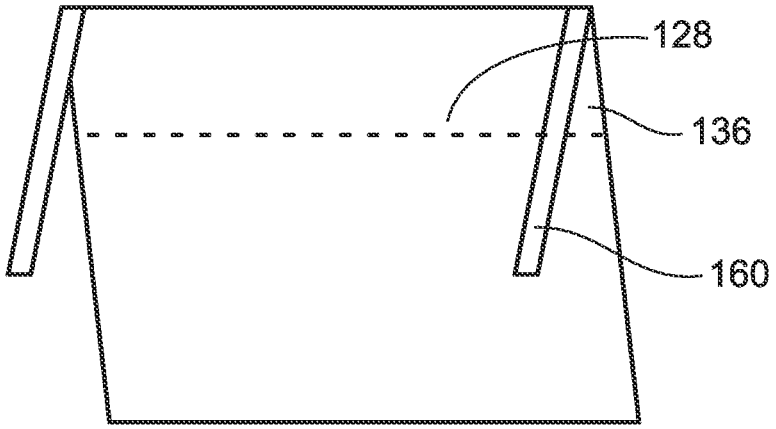
FIG. 4 is a perspective view of the safety pocket of FIG. 3 before installation.
Figure 5:
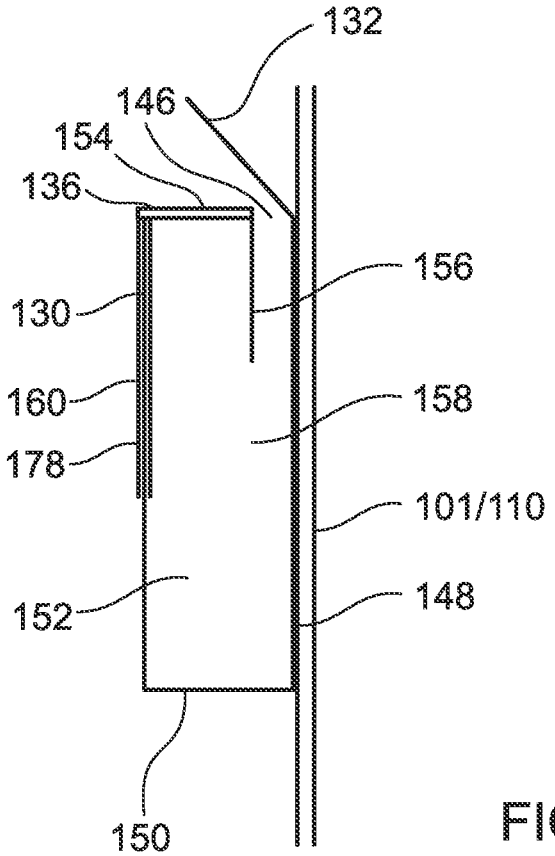
FIG. 5 is a side view of the safety pocket of FIGS. 3 and 4, installed on a standard work shirt.

Referring to FIGS. 3 to 5, a second preferred embodiment of the invention will be described, where a similar pocket to pocket 28 is described but retrofitted to standard shirt 101. Standard shirt 101 has front 110, and standard pocket 111 into which safety pocket insert 128, the retrofit form of the invention may be installed. The retrofit aspect is very useful commercially to enable both full shirts and inventive inserts to be sold, and the ability of consumers to be able to adapt all their shirts to include the safety pocket feature.

Safety pocket insert 128 works in the exact same way as safety pocket 28 described above but instead of being formed in shirt 1, is able to be inserted or removed as need be, by the wearer. Safety pocket insert 128 is fitted into standard pocket 111, which includes front wall 130, flap 132 and button 134, all of a standard form. Safety pocket insert 128 includes safety catch 136 which is exactly as described for safety catch 36 above and works in the same way to prevent items falling out when a person leans or tips forward.

Opening 146 of pocket 111 is defined by front wall 130, back wall 148, around base 150 and sides 152, and is a standard size. Safety pocket insert 128 fits into the standard pocket and it is envisaged that several sizes will be provided for sale to fit most standard pocket sizes. Safety catch 136 importantly again includes top 154 and back 156 into which items in space 158 "catch" if the wearer leans forward. The retrofit aspect is achieved by a pair of strong metal clips, with a smooth side and an undulating catching side which slide over the pocket easily in one direction but strongly resist removal in the other direction due to the undulating catching side. Similar undulations are used in tie pins or money clips to strongly hold valuable items until it is intended that they be removed. Side clips 160 are slid over front of pocket 130 and grip and strongly hold in place, with safety catch 136 positioned at opening 146, as for the first embodiment.

Again as the person leans forward any items catch in and are prevented from being lost from the pocket. To remove an item the person flips the safety catch out of the way and can easily take out the item. The method is far easier and quicker than use of a button and so will actually be used, whereas buttons are often left undone in a person's hurry. Further the catching strongly holds the items so these will not be lost, or smashed or fall in the muck and strong advantage that makes the invention highly desirable.

REFERENCE SIGNS LIST:

| | | | |
|---|---|---|---|
| 1 | Improved Shirt | 101 | Standard work shirt |
| 10 | Front of shirt | 110 | Front of shirt |

-continued

| REFERENCE SIGNS LIST: | | | |
|---|---|---|---|
| 12 | First sleeve | 111 | Standard pocket of shirt |
| 14 | Second sleeve | | |
| 16 | First cuff | | |
| 18 | Upper part of first cuff | | |
| 20 | Lower part of first cuff | | |
| 22 | Second cuff | | |
| 24 | Upper part of second cuff | | |
| 26 | Lower part of second cuff | | |
| 28 | First safety pocket | 128 | Safety pocket insert |
| 30 | Front wall of first safety pocket | 130 | Front wall of pocket |
| 32 | Flap of first safety pocket | 132 | Flap of first safety pocket |
| 34 | Button of Flap | 134 | Button of Flap |
| 36 | Safety catch | 136 | Safety catch |
| 38 | Second safety pocket | 138 | |
| 40 | Front wall of second safety pocket | 140 | |
| 42 | Flap of second safety pocket | 142 | |
| 44 | Button of Flap | 144 | |
| 46 | Opening of first safety pocket | 146 | Opening of pocket |
| 48 | Back wall of first safety pocket | 148 | Back wall of pocket |
| 50 | Base of first safety pocket | 150 | Base of first safety pocket |
| 52 | Side wall of first safety pocket | 152 | Side wall of pocket |
| 54 | Top of safety catch | 154 | Top of safety catch |
| 56 | Back wall of safety catch | 156 | Back wall of safety catch |
| 58 | Space inside first safety pocket | 158 | Space inside pocket with insert |
| | | 160 | Side clips for insert |

The invention claimed is:

1. A work shirt with safety pocket comprising:

a work shirt, the work shirt having a pair of sleeves and at least one safety pocket attached to a front surface of the safety shirt;

the pair of sleeves having a pair of multipart cuffs, each of the multipart cuffs located at an end of one of the pair of sleeves such that each of the multipart cuffs is located proximate each hand of a person when the person is wearing the work shirt, each of the multipart cuffs having an upper part and a lower part, which enables the person wearing the work shirt to extend the upper part and the lower part of each of the cuffs independently, such that each multipart cuff may be configured in a short configuration with both the upper portion and the lower portion elevated from the hand, in a middle configuration where the lower portion is extended to cover a portion of the hand, or a long configuration where the upper portion and the lower portion are both extended;

the at least one safety pocket comprising a base, a pair of sides and a front wall, the base and pair of sides securely attached to and extending from a safety pocket back wall, the safety pocket back wall being either a front side of the work shirt or a wall securely attached to the front side of the work shirt, and the front wall securely attached to the base and pair of sides to form a substantially cuboid shape;

a safety pocket insert comprising a plurality of metal clips and a safety catch;

the safety pocket insert removably attached to at least one of the front wall or the pair of sides via the plurality of metal clips and the safety catch securely attached to a top end of each of the plurality of metal clips, the top end of each of the plurality of metal clips positioned near a top edge of the front wall or a top edge of the pair of sides;

the safety catch comprising a safety catch top extending between the pair of sides and having a distal end, and a safety catch back wall extending from the distal end in a direction substantially perpendicular to the safety catch top, said safety catch capable of moving between an open configuration and a closed configuration;

the closed configuration comprising the safety catch top oriented substantially parallel to the base and extending a majority of the distance between the front wall and the safety pocket back wall and terminating at the distal end of the safety catch top, and the safety catch back wall extending from the distal end of the safety catch substantially perpendicular to the safety catch top and toward the base in an orientation substantially parallel with the safety pocket back wall, such that an opening is located between the distal end of the safety catch top and the safety pocket back wall, and the open configuration comprising the safety catch rotated away from the base such that the safety catch top is not parallel with the base and the opening is enlarged when compared to the closed position, wherein in the open configuration one or more items are placed within the safety pocket and the one or more items are held securely within the pocket in the closed configuration.

2. The work shirt with safety pocket of claim 1, wherein the safety catch is comprised of metal.

3. The work shirt with safety pocket of claim 1, further comprising a flap located above the safety pocket and extending from the front side of the work shirt, the flap secured to the front wall via a button or press-button.

4. The work shirt with safety pocket of claim 1, wherein each multipart cuff extends the length of each sleeve by 150 millimetres to give hand coverage.

5. The work shirt with safety pocket of claim 1, wherein the safety pocket is a pocket of at least 100 millimetres square.

6. The work shirt with safety pocket of claim 1, wherein the safety pocket is 115 millimetres by 115 millimetres.

* * * * *